US007140836B2

(12) United States Patent
Balsdon

(10) Patent No.: US 7,140,836 B2
(45) Date of Patent: Nov. 28, 2006

(54) CASING ARRANGEMENT

(75) Inventor: Julian G. Balsdon, Bristol (GB)

(73) Assignee: Rolls Royce PLC, London (GB)

( * ) Notice: Subject to any disclaimer, the term of this patent is extended or adjusted under 35 U.S.C. 154(b) by 0 days.

(21) Appl. No.: 11/289,545

(22) Filed: Nov. 30, 2005

(65) Prior Publication Data

US 2006/0115356 A1 Jun. 1, 2006

(30) Foreign Application Priority Data

Dec. 1, 2004 (GB) ..... 0426461.0

(51) Int. Cl.
*F01D 25/14* (2006.01)

(52) U.S. Cl. ..... 415/116; 415/173.1; 415/178

(58) Field of Classification Search ..... 415/173.1
See application file for complete search history.

(56) References Cited

U.S. PATENT DOCUMENTS 3,864,056 A 2/1975 Gabriel et al.
5,048,288 A 9/1991 Bessette et al.
5,993,150 A * 11/1999 Liotta et al. ..... 415/115

FOREIGN PATENT DOCUMENTS

GB 839915 A 6/1960
GB 1484288 A 9/1977

* cited by examiner

*Primary Examiner*—Richard A. Edgar
(74) *Attorney, Agent, or Firm*—Oliff & Berridge, PLC

(57) ABSTRACT

A casing arrangement (20) for surrounding a rotary component (16) of a gas turbine engine (10) especially a turbine is disclosed. The arrangement (20) comprises an annular casing member (22A) surrounding a bladed rotary section, such as a turbine stage. An array of gas path liner segments are suspended from the casing at a nominal clearance gap form the tips of the rotary blades. Running clearance is determined by expansion and contraction of the casing which, in turn, is controlled by a supply of heat transfer fluid passed through heat transfer holes in the casing. The casing arrangement described includes a passive pressure bleed effective during engine deceleration to reduce a pressure differential driving the fluid flow in order to avoid too rapid contraction of the casing as a result of overcooling.

7 Claims, 3 Drawing Sheets

CASING ARRANGEMENT

This invention relates to an improved casing arrangement for a gas turbine engine. In particular, but not exclusively, the invention relates to an improved casing arrangement surrounding a rotary turbine section providing better turbine blade tip clearance control.

For best turbine operating efficiency it is necessary to ensure a minimum tip clearance between the tip of the turbine blades and the internal face of the surrounding casing. Typically the inner annular face of the turbine casing is formed by a ring of casing liner segments individually suspended from an outer casing structure. The temperature of this structure thus determines the radius of the liner segment annulus. During operation the liner segments and the supporting structure absorb heat from the hot gases passing through the turbine and expand. The gas temperature changes rapidly during acceleration and deceleration demands but because of its thermal mass and relative remoteness from the gas stream, expansion and contraction of the supporting structure lags the gas temperature change and the expansion or contraction of the rotating turbine blades. Consequently the clearance gap between relatively static liner segments and the tips of the rotating blades can increase and decrease, even close completely, leading temporarily to loss of turbine efficiency and possibly blade tip rubs.

A number of previous attempts have been made to solve these drawbacks, and these can be categorised as either active or passive. Active control, for example involves valves that are opened and closed to bleed either hot or cool air over the structure to directly influence its expansion and contraction. Passive arrangements, on the other hand, use no moving parts to control the heating/cooling air supply relying instead on pressure differentials and supply orifice sizes to control the air. An example of a passive tip clearance control system was described in our earlier filed GB Patent Application No 0403198.5.

According to one aspect of this invention, there is provided a casing arrangement for surrounding a rotary component of a gas turbine engine comprises an annular supporting structure, a circumferentially extending array of part annular members suspended from the supporting structure, a fluid chamber arranged to receive a supply of heat transfer fluid from a source thereof at a pressure dependent upon engine speed, fluid conduit means in open communication with the fluid chamber at one end and a region of lower pressure at the other end, and in thermal contact with the supporting structure whereby to influence the extent of thermal expansion and contraction of the supporting structure in accordance with a pressure differential between the fluid chamber and the region of lower pressure, and at least one fluid pressure bleed hole leading from the chamber, the size of the at least one pressure bleed hole relative to the total inlet area of the fluid conduit means being chosen such that, when fluid chamber pressure increases during engine acceleration, above a predetermined pressure the bleed flow from the chamber is choked so that further increases in pressure act across the fluid conduit means, and when fluid chamber pressure decreases during engine deceleration the bleed flow is no longer choked a greater proportion of total flow passes through the at least one fluid pressure bleed hole.

Preferably the heat transfer fluid comprises cooling fluid derived from the high-pressure compressor of the gas turbine engine.

Alternatively the heat transfer fluid comprises heating fluid which may be derived from a turbine stage of the gas turbine engine.

Embodiments of the invention will now be described by way of example only, with reference to the accompanying drawings, in which.

Figure 1:
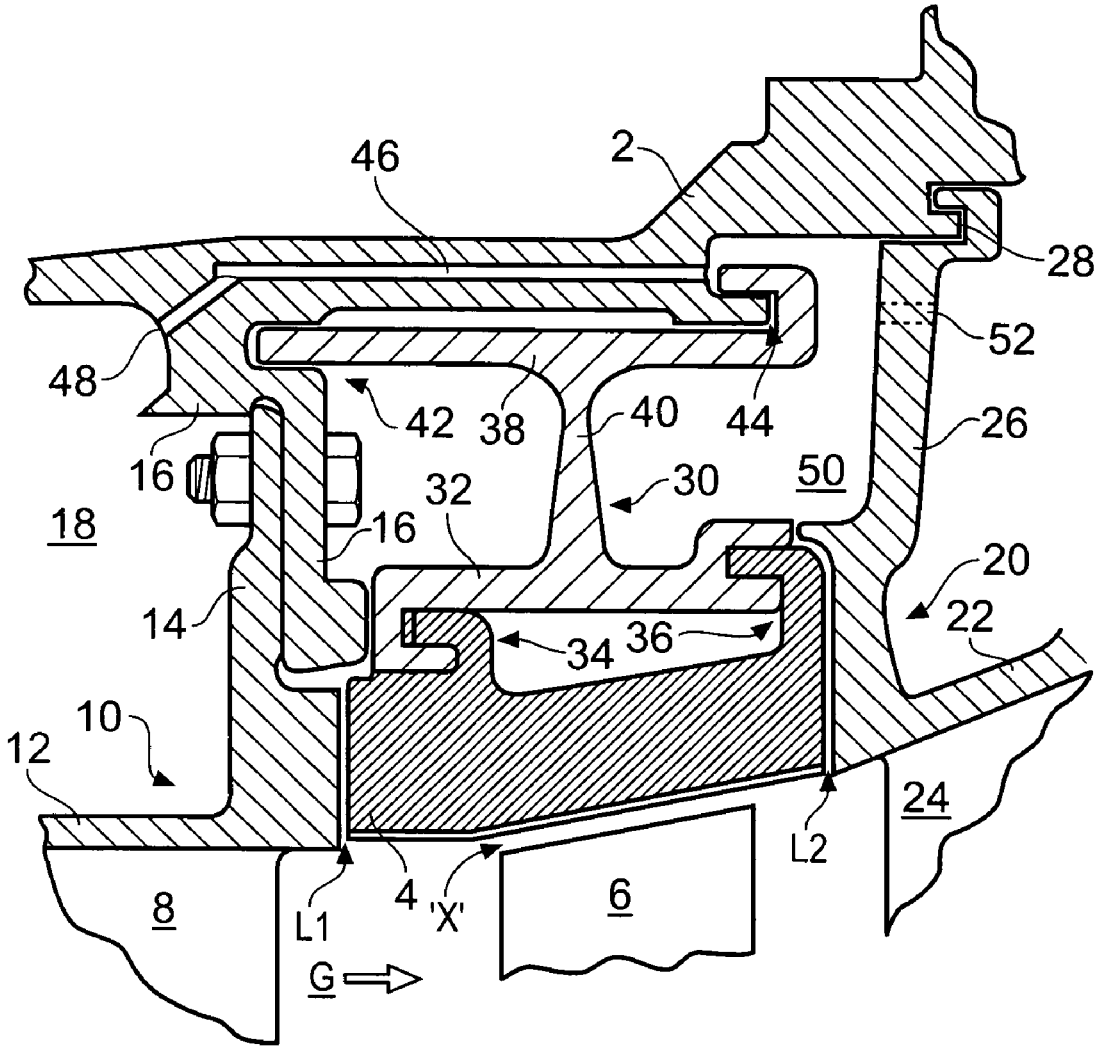
Fig. 1. PRIOR ART
FIG. 1 is a section along the engine axis through part of a known turbine casing configuration incorporating a heat transfer arrangement for tip clearance control.

Referring initially to the arrangement illustrated in FIG. 1 a section of turbine casing is shown generally at 2, surrounding a circular array of turbine liner segments 4 which, in turn, surround a turbine rotor the tip of one of the blades of which is indicated at 6. The turbine section illustrated is a high-pressure (HP) stage, that is the first turbine rotor stage after the combustor (not shown). At the left side of the drawing there is shown at 8 a portion of one HP nozzle guide vane forming part of a stator ring 10 between the combustor and the HP turbine.

In the nozzle guide vane ring 10 the gas path G is defined by a radially outer shroud ring 12, to which the radially outer ends of the vanes 8 are joined or are formed integrally therewith. The downstream side of ring 12 is formed as a radially upstanding annular flange 14 which is mounted to a corresponding radially depending flange 16 formed on the interior of the turbine casing 2. The ring 12, flanges 14, 16 and casing 2 together with other parts not shown to the left of the drawing form a chamber 18. As described in our co-pending application GB 0403198.5 this chamber 18 may be supplied with heating or cooling fluid derived from a source, for example high-pressure (HP) compressor air.

On the right of FIG. 1, on the downstream side of the HP turbine, there is shown at 20 a further guide vane ring 22 leading to subsequent turbine stages (not shown). The gas path through this stage is defined by the radially inner surface of the ring 22 to which the radially outer ends of the vanes 24 are joined or are formed integrally therewith. The upstream side of ring 20 is formed as a radially upstanding annular flange 26 which, in this arrangement, is mounted to the turbine casing at 28 by means of a hooked mounting.

Each of the turbine liner segments 4, when viewed in the axial direction that is perpendicular to the plane of the drawing is shaped as part of the arc of a large diameter circle. Each segment is suspended by its own intermediate member, generally indicated at 30, from the outer casing 2. Each intermediate member 30 is formed with a radially inner, axial flange 32 which carries a segment 4 by means of hooked mountings 34, 36 at its upstream and downstream edges respectively.

The radially inner flanges 32 are joined to a radially outer, axially extending flange 38 by a central support member 40. In turn each flange 38 is mounted to the outer casing 2 at mounting points 42, 44 at the upstream and downstream ends of the flange. When all of the segments are assembled inside the turbine casing with circumferential edges of the segments in end-to-end abutment, they form a complete ring encircling the turbine stage. The dimensions of the segments and the rotor stage are chosen such that at assembly, ie at room temperature, there is a nominal cold build clearance or gap "X" between the inner surface of the liner segments 4 and the tips of the turbine blades 6.

Thus, in the casing arrangement as so far described, the clearance gap "X" is influenced during engine operation by a number of factors in particular the temperature of the turbine casing. As the temperature of the casing 2 increases its diameter expands and carries the intermediate members 30 outwards tending to increase the clearance gap "X". Similarly when the temperature of the casing falls it contracts reducing the clearance gap.

However casing expansion and contraction tends to lag behind gas temperature changes largely because the turbine casing 2 has a significant thermal mass and is shielded from the source of heat, ie the hot gas in the turbine gas path. The gap "X" is also determined by the radial growth of the radius of the turbine rotor, which is due to two major factors: first thermal growth due to the temperature of the rotor, and second centrifugal growth due to the speed of rotation. In steady state running conditions the degree to which the turbine casing is expanded or contracted can be arranged to compensate for the effects of these factors. During engine acceleration and deceleration the factors influencing the gap "X" change at different rates. The additional time factors can result in the gap being closed temporarily.

Figure 2:
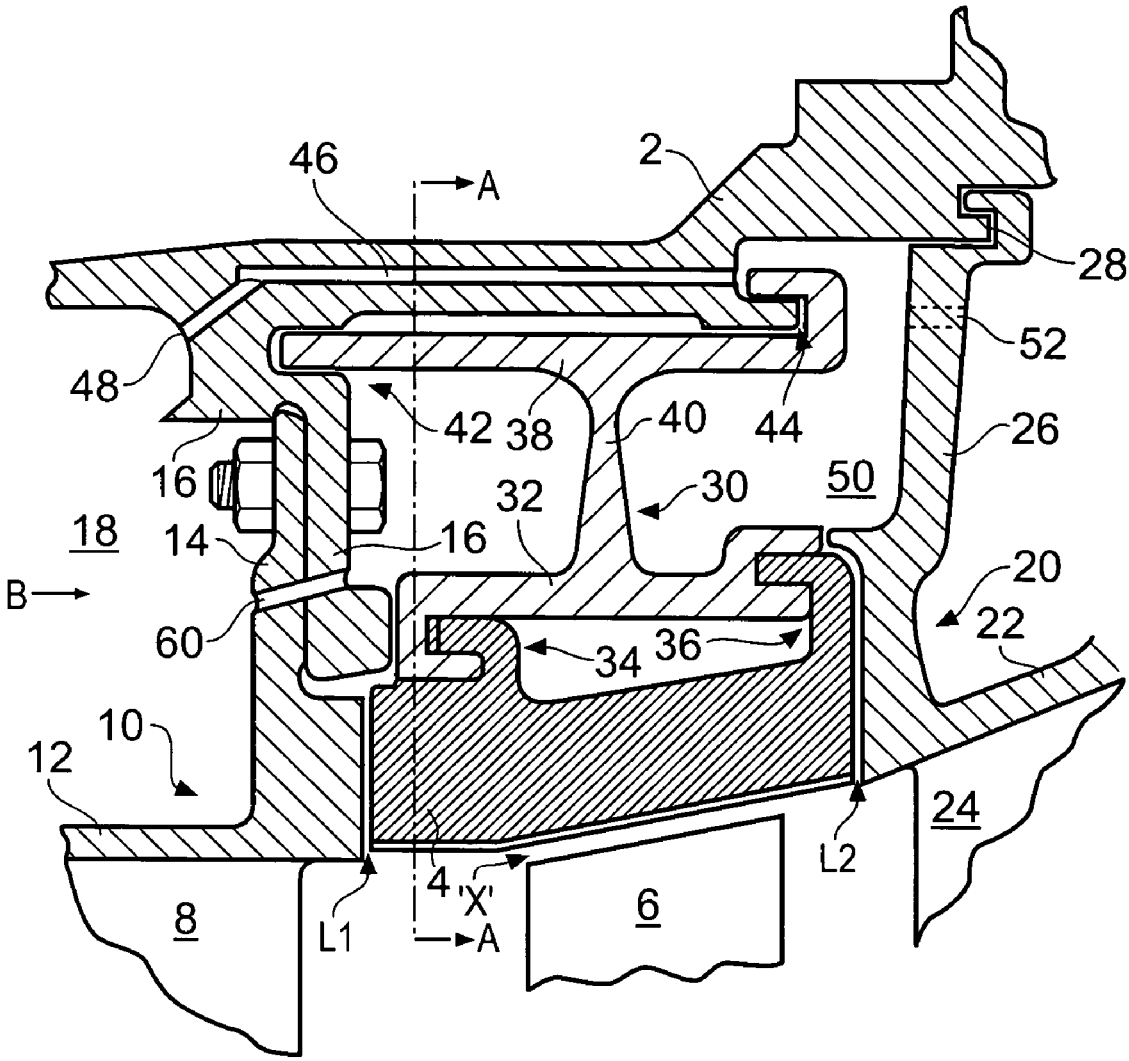
FIG. 2 is a section through the arrangement of FIG. 1 modified in accordance with the present invention.
Figure 3:
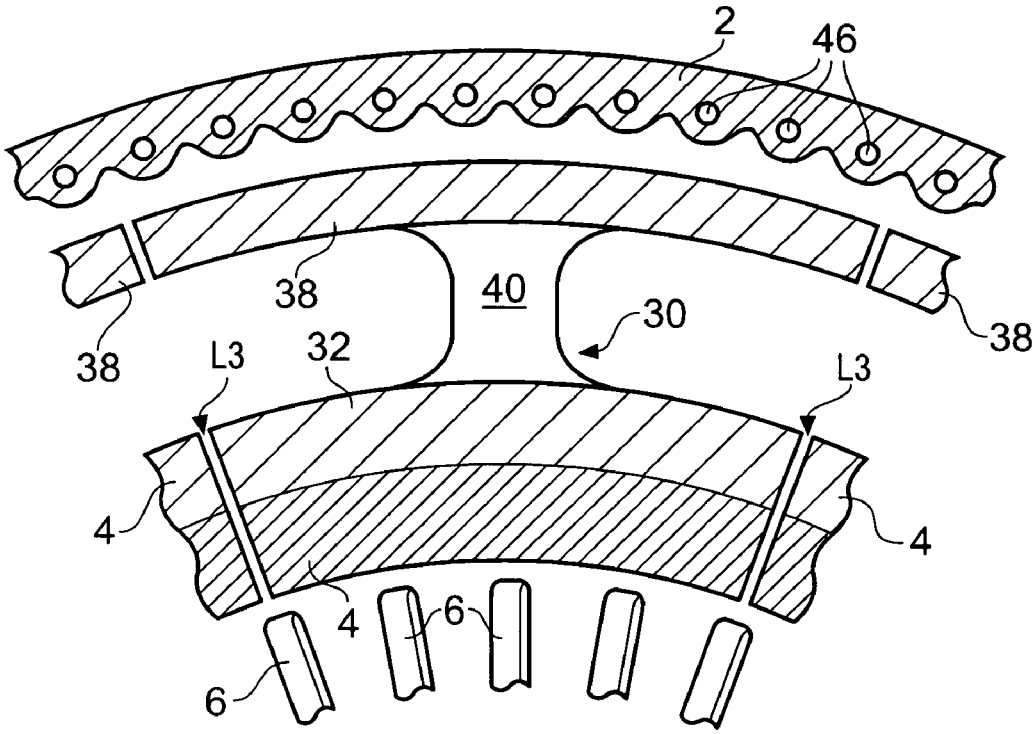
FIG. 3 is a view through the arrangement of FIG. 2 on cross-section AA in FIG. 2.

In the illustrated prior art arrangement provision is made to pass a heat transfer fluid, normally air derived from the high-pressure compressor section of the engine, through parts of the turbine casing in order to control its expansion and contraction. In FIG. 1 numerous small diameter holes 46 are formed in the casing section 2 so that the temperature of the casing is directly influenced by the temperature of the fluid passing through the holes. The holes 46 are formed parallel to and closely spaced from each other, and also to the walls of the casing section 2 for even and rapid heat transfer. FIG. 3, a view on section AA common to the prior art arrangement of FIG. 1 and of the invention of FIG. 2, indicates the number and spacing of these holes 46. The heat transfer fluid is supplied to chamber 18 and from there passes through feed holes 48 in the shoulder of casing flange 16 into the near end of the heat transfer holes 46. At the opposite ends the holes 46 open into another chamber 50 bounded on the upstream and downstream sides respectively by flanges 16 and 26, and closed on the gas path side by the liner segments 4. The chamber 50 is allowed to vent through a number of leakage or clearance gaps between components, for example into the gas path G through gaps L1 and L2 on the upstream and downstream sides of the liner segments 4 and through gaps L3 (FIG. 3) between adjacent liner segments. In addition, if required, a special vent passage such as shown by the dashed lines at 52 through flange 26 may be required.

The arrangement described above may form the basis of an active or passive tip clearance control system depending upon whether the source of heat transfer fluid to chamber 18 is actively managed by controlled valves (not shown) and/or whether the fluid is itself heated or cooled according to casing temperature requirements. A passive arrangement with no actively energised valves or control switching may be preferred for simplicity, reliability and lightness.

In a passive arrangement of this kind the chamber 18 is permanently connected to a receive air from a high-pressure (HP) compressor bleed (not shown). How well the system functions is governed by a number of parameters some of which are fixed while others vary. For example the pressure in chamber 18 varies according to HP pressure and therefore with engine speed, so the pressure differential between chambers 18 and 50 changes according to engine cycle but the total area of the heat transfer passages 46 is fixed. The rate of heat transfer is dependent upon the rate of flow of heat transfer fluid through the passages 46, so in the absence of a controlled variable parameter the operation of the system is inevitably a compromise. It has been found that one such system gave a significant benefit during engine acceleration, as it achieved rapid expansion of the turbine casing and allowed for radial growth of the rotor as its speed and temperature increased. However, the same arrangement suffered from a drawback of over-rapid shrinkage during engine deceleration leading to closure of the over-tip clearance gap. The present invention is intended to provide a solution to this problem among other potential benefits.

Figure 4:
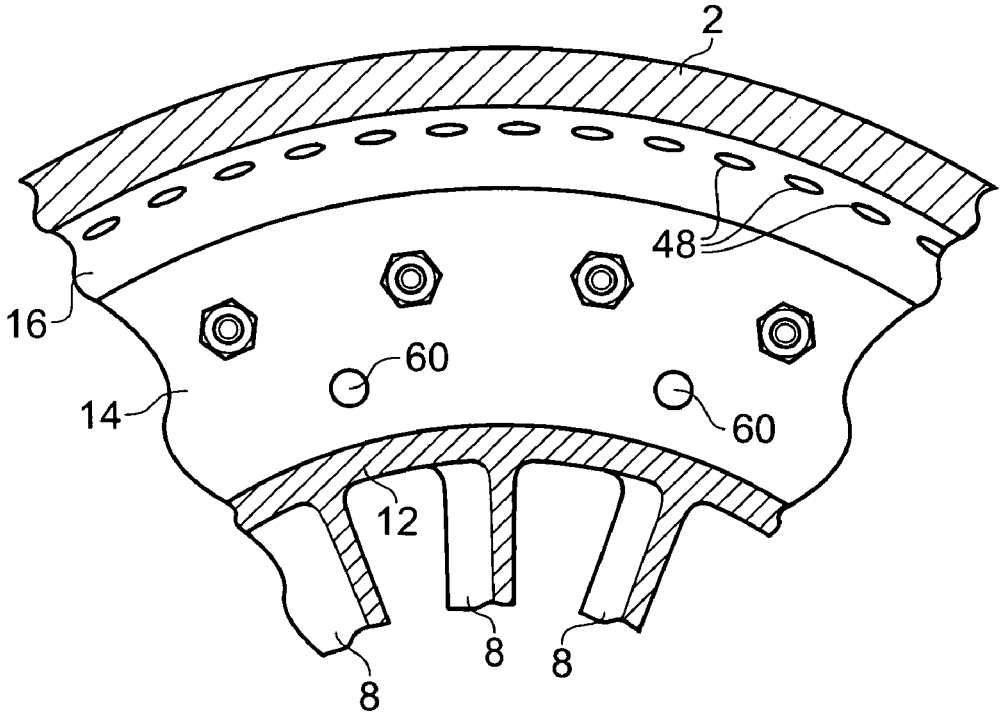
FIG. 4 is a view through the arrangement of FIG. 2 in the direction of arrow B.

Referring now to the remaining figures of the drawings, there is shown an improved form of the known arrangement of FIG. 1, like parts carry like references. In the modified arrangement, as shown in FIGS. 2 and 4, the improvement comprises at least one fluid pressure bleed hole 60 piercing the flange members 14, 16. The holes 60 lead from the chamber 18 directly into the chamber 50 and bypass the heat transfer passages 46, 48.

The bleed holes 60 are permanently open so there is a continuous flow of fluid from chamber 18 into chamber 50. Since chamber 50 is vented into the gas path G through a plurality of leakage gaps between components the pressure in chamber 50 can never build up sufficiently to equal the pressure in chamber 18. The total inlet orifice area of the pressure bleed holes 60 relative to the total inlet orifice area of the heat transfer passages 48 in chamber 18 is chosen such that when the pressure differential between the two chambers 18, 50 exceeds a predetermined level the bleed flow from chamber 18 through holes 60 is choked. A flow orifice is said to be choked when the rate of fluid flow through it has reached its theoretical maximum level. Above the pressure differential level at which the holes 60 becomes choked further increases in the pressure in chamber 18 produce no increase in the flow rate through the bleed holes.

The total inlet orifice area of the heat transfer passages 46, 48, however, is chosen so the flow through these passages continues to be pressure driven above the level at which the bleed holes 60 become choked. The result is that the heat transfer fluid that bypasses the heat transfer holes 46, 48 reduces as a proportion of the total flow the greater the pressure of the fluid source and in chamber 18 becomes. Above the predetermined pressure level the reduction becomes increasingly less significant. Below the said predetermined pressure level the flow from chamber 18 to chamber 50 is divided between the two possible paths, that is through the passages 46, 48 and the bleed holes 60. The flow through both paths is pressure driven flow. The effect of the relative sizes of the inlet orifices 48 and 60 is more significant. In particular, the total inlet orifice area of the one or all of the bypass bleed holes 60 is chosen so that the flow through the bypass represents a significant proportion of the total combined flow. The effect of the presence of the bleed hole(s) 60 is to increase the proportion of the total flow through bypass hole(s) 60 during engine deceleration and consequently to reduce the proportion of total flow through the heat transfer passages 46, 48. Thus, when fluid chamber pressure decreases during engine deceleration the bleed flow is effective to reduce fluid flow through the heat transfer passages 46,48. As a result the amount of cooling of the turbine casing 2 is decreased during engine deceleration. The casing shrinks more slowly thereby maintaining a greater tip clearance gap "X" relative to the same arrangement without the bleed hole(s) 60.

The invention claimed is:

1. A casing arrangement for surrounding a rotary component of a gas turbine engine comprises an annular supporting structure, a circumferentially extending array of part annular members suspended from the supporting structure, a fluid chamber arranged to receive a supply of heat transfer fluid from a source thereof at a pressure dependent upon engine speed, fluid conduit means in open communication with the fluid chamber at one end and a region of lower pressure at the other end, and in thermal contact with the supporting structure whereby to influence the extent of thermal expansion and contraction of the supporting structure in accordance with a pressure differential between the fluid chamber and the region of lower pressure, and at least one fluid pressure bleed hole leading from the chamber, the size of the at least one pressure bleed hole relative to the total inlet area of the fluid conduit means being chosen such that, when fluid chamber pressure increases during engine acceleration, above a predetermined pressure the bleed flow from the chamber is choked so that further increases in pressure act across the fluid conduit means, and when fluid chamber pressure decreases during engine deceleration and the bleed flow is no longer choked a greater proportion of total flow passes through the at least one fluid pressure bleed hole.

2. A casing arrangement as claimed in claim 1, wherein the heat transfer fluid comprises cooling fluid.

3. A casing arrangement as claimed in claim 2, wherein the supply of heat transfer fluid is derived from the high-pressure compressor of the gas turbine engine.

4. A casing arrangement according to claim 1, wherein the heat transfer fluid comprises heating fluid.

5. A casing arrangement according to claim 4 wherein the supply of heating fluid is derived from a turbine of the gas turbine engine.

6. A turbine arrangement incorporating a casing arrangement as claimed in claim 1.

7. A gas turbine engine incorporating a turbine having a casing arrangement as claimed in claim 6.

* * * * *